US007147522B2

(12) United States Patent
Kobayashi et al.

(10) Patent No.: US 7,147,522 B2
(45) Date of Patent: Dec. 12, 2006

(54) TERMINAL FITTING AND A CONNECTOR PROVIDED THEREWITH

(75) Inventors: Yutaka Kobayashi, Yokkaichi (JP); Hajime Kawase, Yokkaichi (JP); Yutaka Noro, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/345,359

(22) Filed: Feb. 1, 2006

(65) Prior Publication Data

US 2006/0172617 A1 Aug. 3, 2006

(30) Foreign Application Priority Data

Feb. 2, 2005 (JP) ..... 2005-026669

(51) Int. Cl.
*H01R 11/22* (2006.01)

(52) U.S. Cl. ..... 439/852; 439/752.5; 439/843

(58) Field of Classification Search ..... 439/843, 439/852, 752.5
See application file for complete search history.

(56) References Cited

U.S. PATENT DOCUMENTS 5,443,592 A * 8/1995 Ittah et al. ..... 439/852
5,743,771 A * 4/1998 Yamaguchi et al. ..... 439/752.5
5,791,945 A * 8/1998 Myer et al. ..... 439/852
6,152,788 A 11/2000 Hata et al.
6,290,554 B1 * 9/2001 Makita et al. ..... 439/852
6,527,601 B1 * 3/2003 Chen ..... 439/852
2002/0025696 A1 2/2002 Irikura et al.

FOREIGN PATENT DOCUMENTS

JP 5-190227 7/1993

* cited by examiner

*Primary Examiner*—James R. Harvey
*Assistant Examiner*—Travis Chambers
(74) *Attorney, Agent, or Firm*—Gerald E. Hespos; Anthony J. Casella

(57) ABSTRACT

A stabilizer (30) is divided into a front stabilizer (31A) and a rear stabilizer (31B) with a small clearance therebetween. The front and rear stabilizers (31A, 31B) are formed from a left side plate (25) and a bottom plate (25) of a main portion (21) by cutting and bending while leaving holes (32A, 32B). The side hole (32A) is relatively larger and exposes a free end (40A) of a resilient contact (40) to the outside. Thus, a rear inner plate (36) is arranged at an inner side of the side hole (32A) to close the side hole (32A). The plastic deformation of a side of the resilient contact (40) towards the free end (40A) is prevented by preventing the intrusion of a tab (51) of a male terminal fitting (50) or other external matters through the side hole (32A).

8 Claims, 11 Drawing Sheets

TERMINAL FITTING AND A CONNECTOR PROVIDED THEREWITH

BACKGROUND OF THE INVENTION

1. Field of the Invention

The invention relates to a terminal fitting with at least one stabilizer and to a connector provided with such a terminal.

2. Description of the Related Art

Japanese Unexamined Patent Publication No. H05-190227 discloses a female terminal fitting that has a rectangular tubular main portion and a resilient contact inside the main portion. The terminal fitting is secured to an end of a wire and then is inserted from behind into a cavity formed in a housing. A stabilizer projects from a side surface of the main portion and is received in a guide groove of the cavity. The stabilizer and guide groove prevent an erroneous (e.g. upside down) insertion of the terminal fitting into the cavity and stably guide the terminal fitting into the cavity.

The above-described stabilizer is formed by making a cut in a side wall of the main portion and bending the cut area. This cutting and bending leaves an opening in the side wall of the main portion. Accordingly, a tab of a mating terminal fitting or other external matter can intrude through the opening and can engage the resilient contact in the main portion. Such engagement can plastically deform the resilient contact.

The invention was developed in view of the above problem and an object thereof is to prevent the intrusion of an external matter into a main portion even through a stabilizer is formed by cutting and bending.

SUMMARY OF THE INVENTION

The invention relates to a terminal fitting with a tubular main portion that can be inserted into a cavity of a connector housing. At least one stabilizer is formed by making at least one cut in the main portion and bending the cut area. The cutting and bending to form the stabilizer creates a hole in the main portion. An inner wall is provided at an inner side near the hole left in the main portion and at least partly closes the hole. Thus, external matter cannot intrude through the hole and into the main portion. Accordingly, a resilient contact in the main portion is not at risk of being plastically deformed by contact with external matter. Further, a tab or stabilizer of one terminal fitting cannot engage in a hole of another terminal fitting. Thus, entanglement is prevented regardless of whether the terminal fittings are female terminal fittings or male terminal fittings.

The main portion preferably is a substantially polygonal tube and a resilient contact is formed in the main portion. At least one projection bulges from a side edge of the resilient contact substantially facing an inner wall of the main portion. The inner wall has at least one preventing portion for engaging the projection and preventing excessive displacement of the resilient contact. The preventing portion also preferably is disposed to close the hole left in the main portion. Thus, the state of the projection of the resilient contact can be confirmed visually from the outside through the hole.

The widthwise center of the resilient contact preferably is offset from the widthwise center of the main portion towards a side opposite the inner wall. The offset disposition of the resilient contact would require a longer projection for preventing excessive displacement if no inner wall was provided. A longer projection could be weaker and less effective. However, the presence of the inner wall enables the projection to be shorter and hence stronger.

The stabilizer preferably is formed from one side plate of the main portion by cutting and bending. The inner wall preferably is arranged at or close to the inner side of the hole left in the side plate.

The resilient contact preferably is formed by being folded back from an end of a plate of the main portion.

The stabilizer preferably is divided into a plurality of parts distanced from each other along forward and backward directions. The respective divided parts of the stabilizer are formed on different sides of the main portion.

One or more preventing portions preferably are provided in the main portion and contact the resilient piece for preventing damage when the resilient contact piece is deflected in a direction other than the deflection direction caused by the mating male terminal fitting inserted into the main portion.

The invention also relates to a connector with a housing having at least one cavity. At least one guide groove is formed the cavity and extends substantially along forward and backward directions. The above-described terminal fitting is inserted into the cavity so that the stabilizer is guided in the guide groove.

These and other features of the invention will become more apparent upon reading of the following detailed description and accompanying drawings. Even though embodiments are separately described, single features may be combined to additional embodiments.

DETAILED DESCRIPTION OF THE PREFERRED EMBODIMENTS

Figure 1:
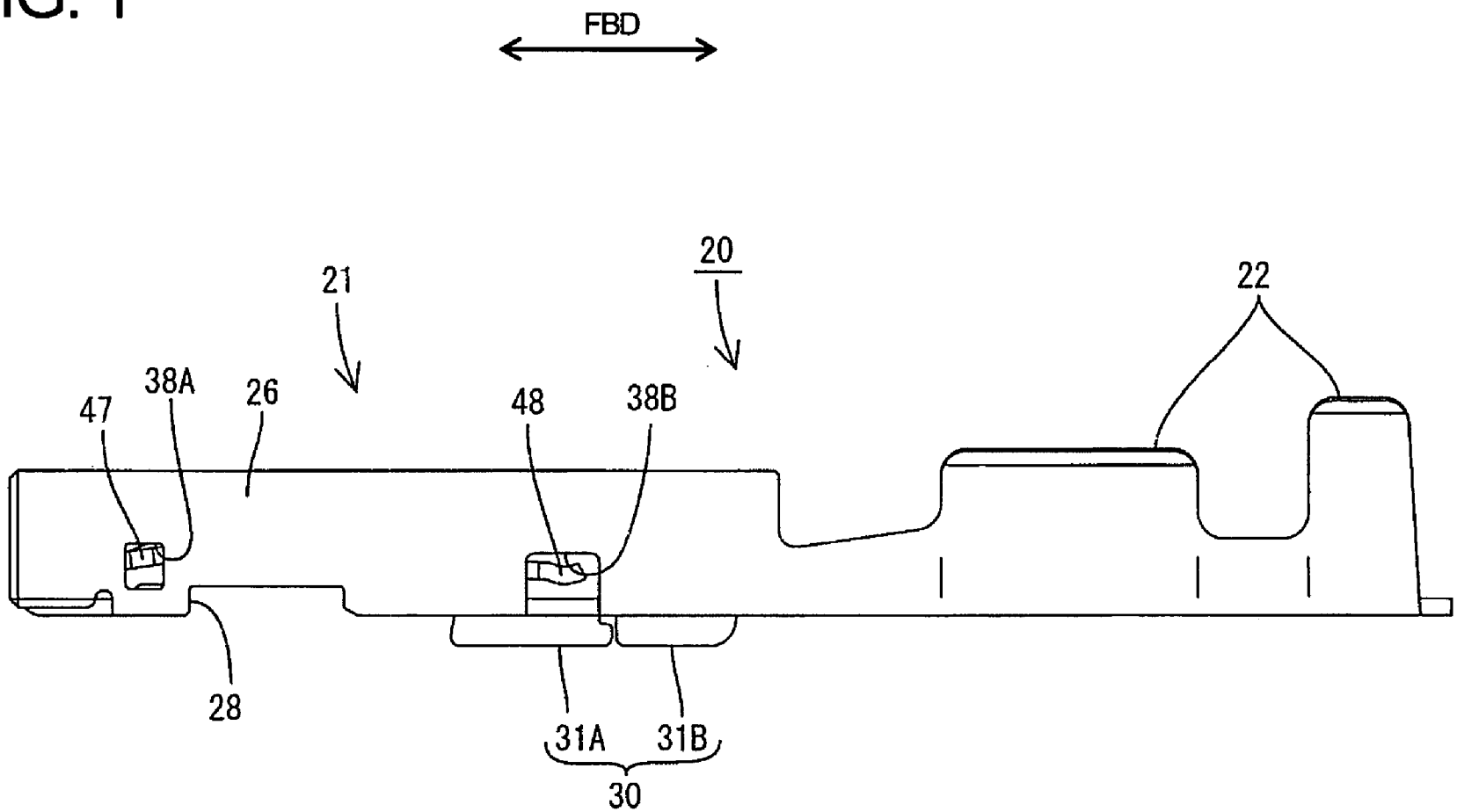
FIG. 1 is a right side view of a female terminal fitting according to one embodiment of the invention.
Figure 2:
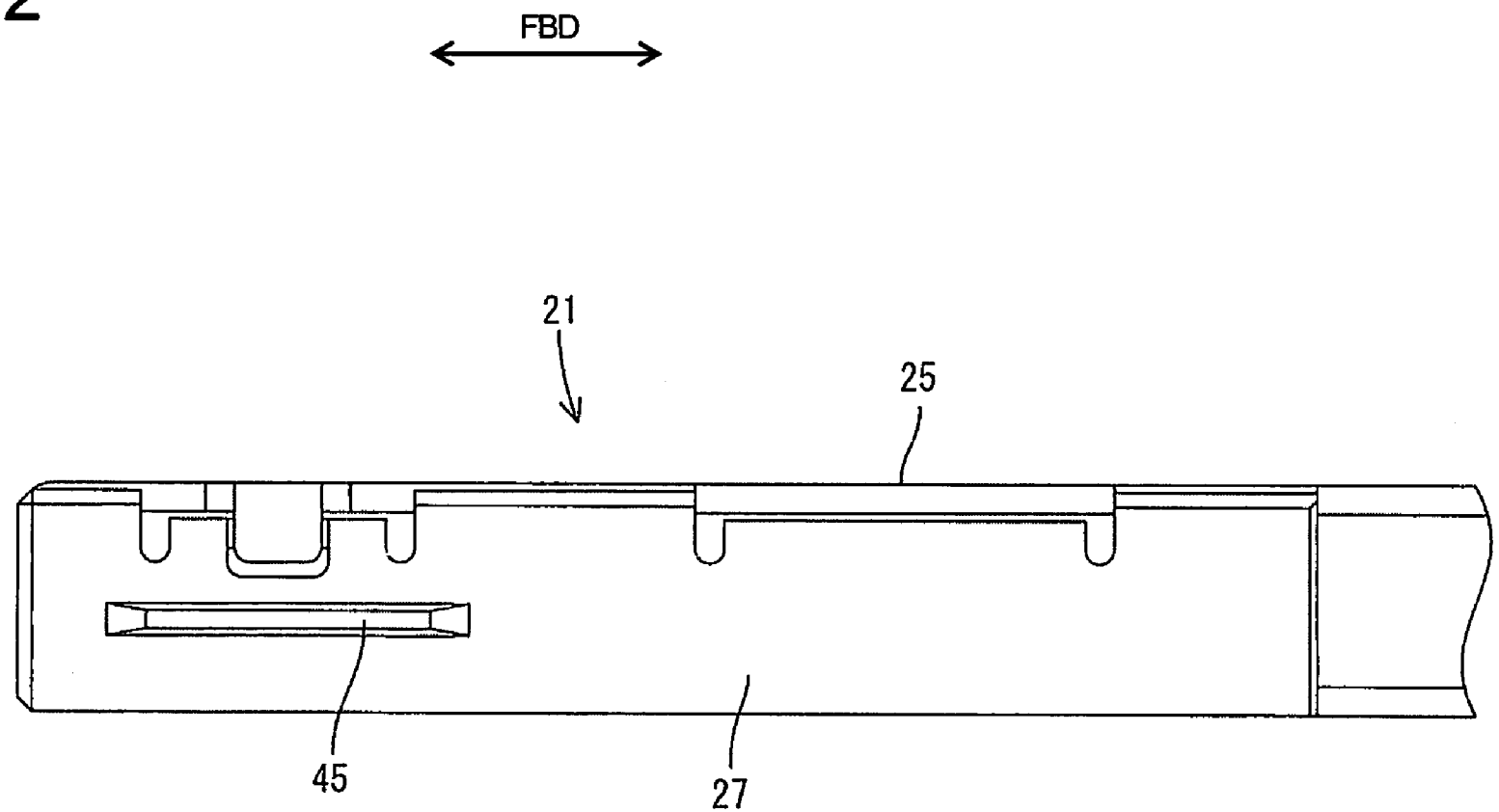
FIG. 2 is a plan view of a main portion of the female terminal fitting.

A female terminal fitting according to the invention is identified by the numeral 20 in FIGS. 1 to 12. A plurality of such female terminal fittings may be inserted into a connector housing 10 shown in FIGS. 11 and 12. The housing 10 is made e.g. of a synthetic resin and cavities 11 penetrate the housing 10 in forward and backward directions FBD. A lock 12 is cantilevered forwardly along the bottom wall of each cavity 11. Further, a guide groove 13 extends substantially in forward and backward directions FBD near the right side of the bottom wall of the cavity 11 when viewed from behind. The guide groove 13 extends from the rear entrance of the cavity 11 to a position near the base end of the lock 12.

Figure 11:
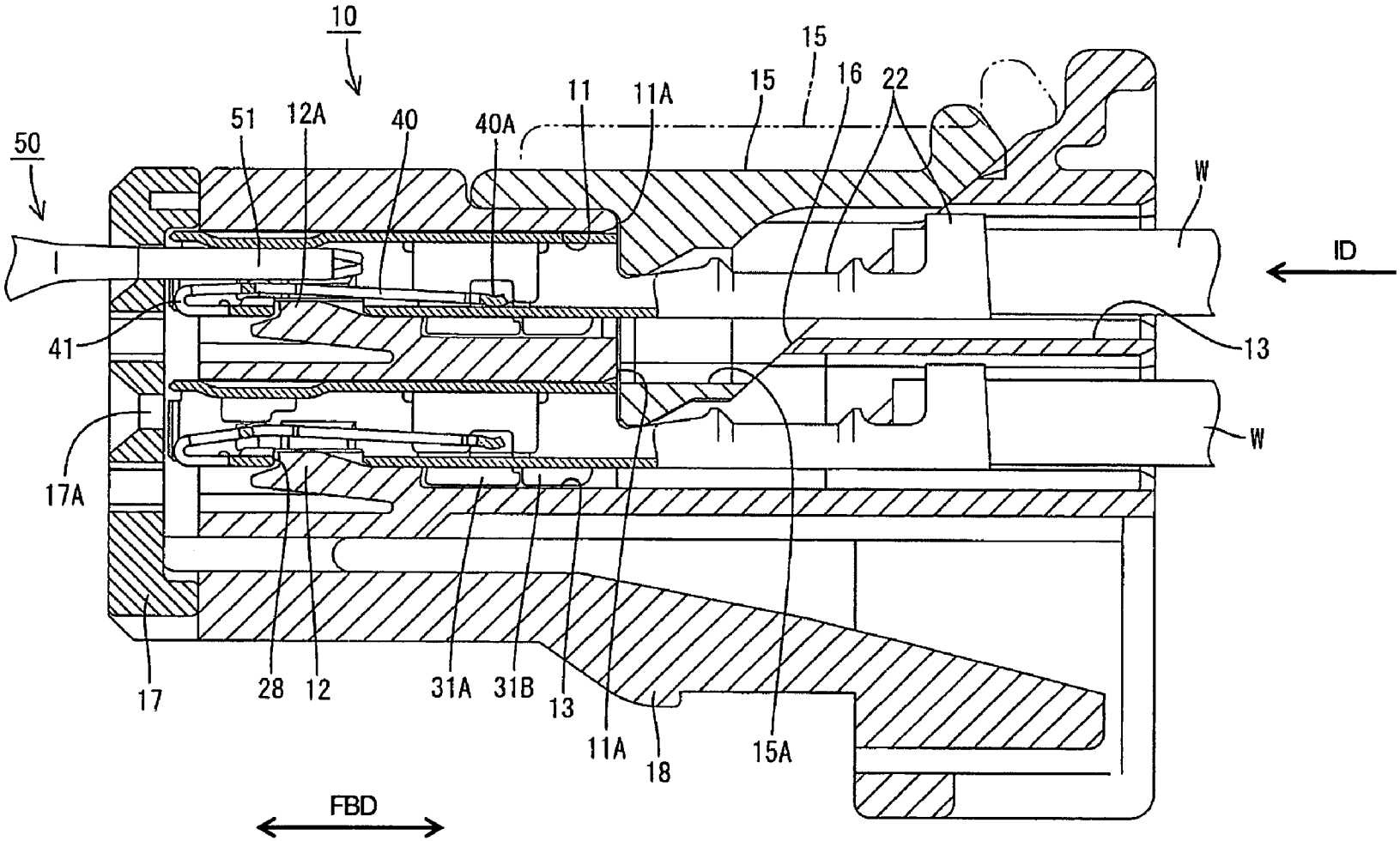
FIG. 11 is a longitudinal section of a connector housing into which the female terminal fittings are inserted.
Figure 12:
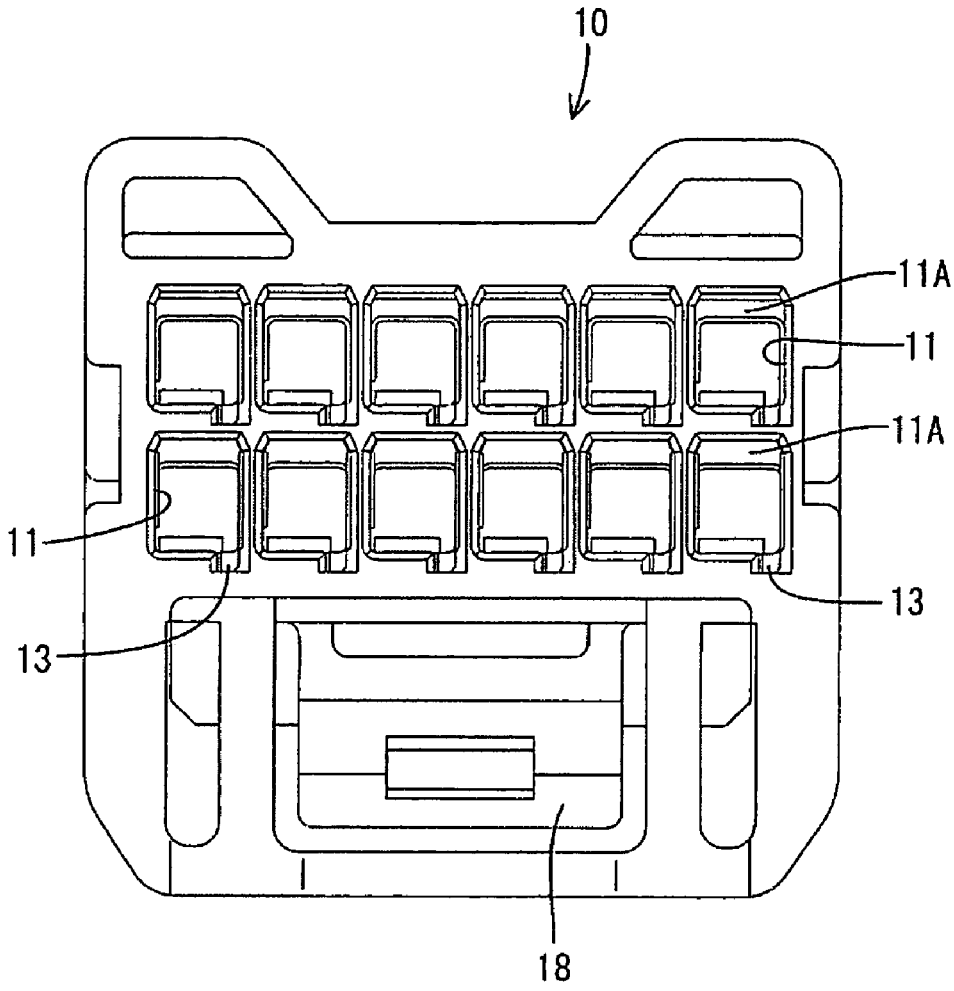
FIG. 12 is a rear view of the connector housing.

A retainer 15 for doubly locking the female terminal fittings 20 is mounted into an upper side of the housing 10 in FIG. 11, and a front plate 17 is to mounted on the front surface of the housing 10. Tabs 51 of male terminal fittings 50 mounted in an unillustrated mating male connector can enter the cavities 11 through tab insertion openings 17A of the front plate 17. A locking arm 18 is provided on the bottom of the housing 10 for locking the housing 10 and the mating male connector in their connected state.

Figure 10:
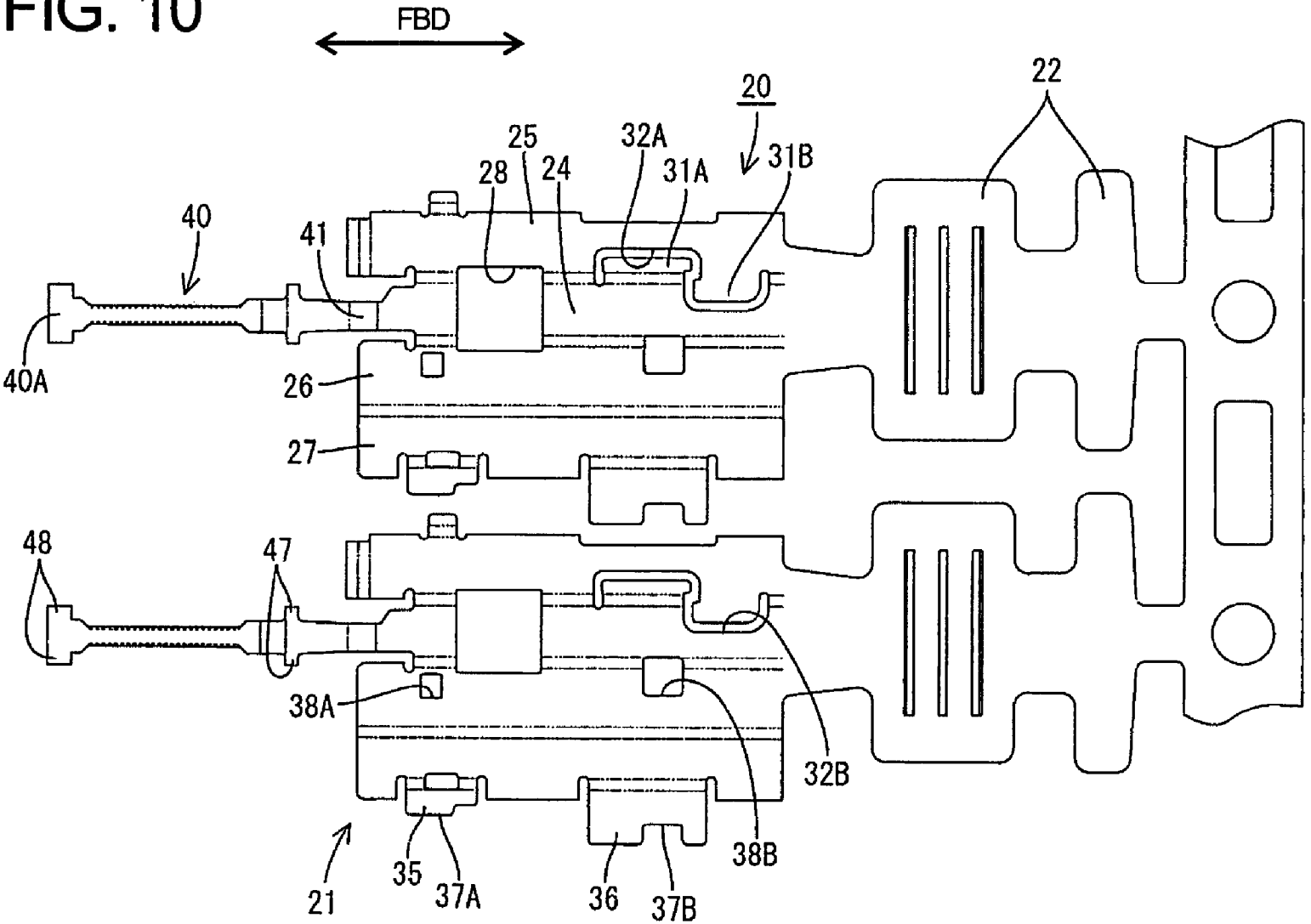
FIG. 10 is a development of the female terminal fitting.

The female terminal fitting 20 is formed by bending, folding, embossing, stamping, pressing and/or cutting a conductive metal plate material stamped or cut out into a specified shape as shown in FIG. 10 and is narrow and long along forward and backward directions FBD. A rectangular tubular main portion 21 is formed at the front of the female terminal fitting 20 and a wire connecting portion 22 is formed at the rear of the female terminal fitting 20. The wire connecting portion 22 has open barrels, as shown in FIG. 1, that can be crimped, bent or folded into electrical connection with an end of a wire W (see FIG. 11).

The main portion 21 is hollow along forward and backward directions FBD and has a long narrow bottom plate narrow and long along forward and backward directions FBD, first and second side plates 25, 26 that project at substantially right angles from the left and right sides of the bottom plate 24, and a ceiling plate 27 that projects from substantially the entire projecting end of the right side plate 26 and extends towards the left side plate 25 and substantially parallel with the bottom plate 24.

A substantially rectangular locking hole 28 is formed over substantially the entire width of the bottom plate 24 at a position near the front end of the bottom plate 24. A locking edge 28A is formed at the front of the locking hole 28 and is engageable with a retaining projection 12A of the lock 12. This locking edge 28A is struck to project in by at least substantially the thickness of the base plate 24 to gain a larger engaging margin.

Figure 7:
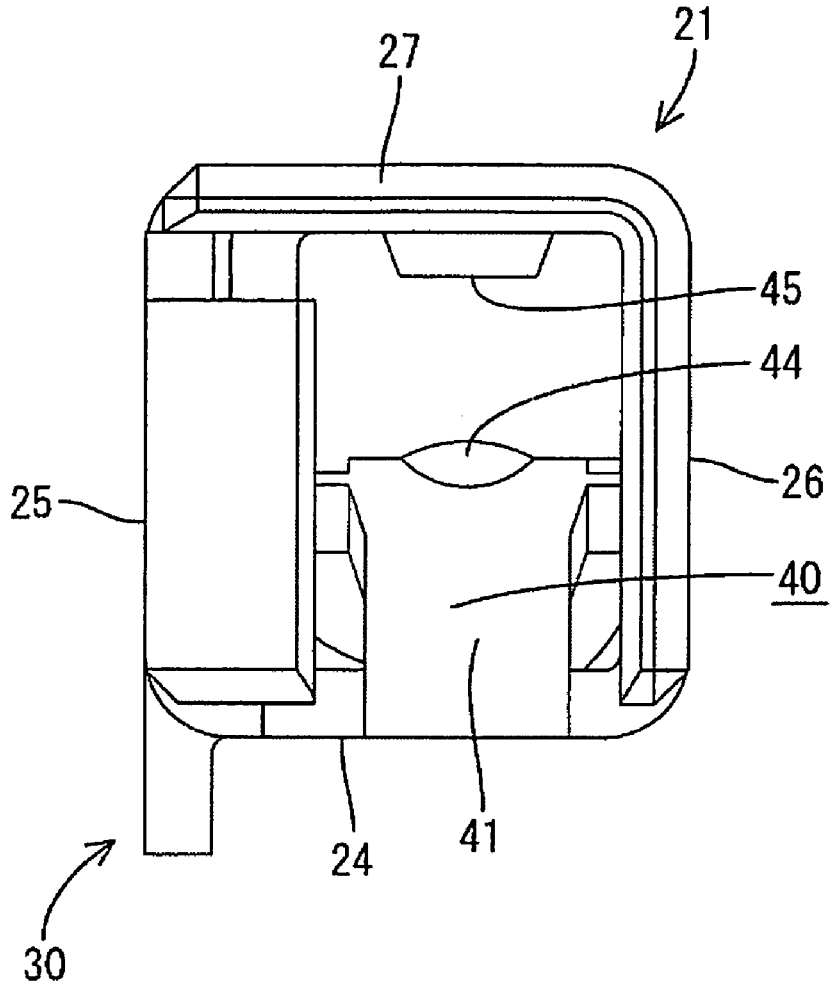
FIG. 7 is a front view of the female terminal fitting.

At least one stabilizer 30 projects out and down a specified distance from the left edge of the bottom plate 24, when viewed from the front, and is at a position on the main portion 21 behind the locking hole 28. The stabilizer 30 extends substantially along the forward and backward directions FBD, and is substantially flush with the left side plate 25, as shown in FIG. 7.

The stabilizer 30 is divided into a front stabilizer 31A and a rear stabilizer 31B with a small clearance therebetween. The front stabilizer 31A is slightly longer along the forward and backward directions FBD than the rear stabilizer 31B, and is formed by making at least one cut in the left side plate 25 and in the bottom 24 from the left edge of the bottom plate 24 and bending this cut portion at the bottom of the left side plate 25 to project down at substantially 90° from the bottom plate 24. A side hole 32A is formed in the left side plate 25 at a position where the cut portion is bent to form the front stabilizer 31A.

A cut is made in the bottom plate 24 from the corresponding bottom edge of the left side plate 25 to form the rear stabilizer 31B. This cut portion remains coplanar with the left side plate 25 and aligns substantially at a right angle to the bottom plate 24 as the left side plate 25 is bent substantially at right angle to the bottom plate 24 during the shaping of the main portion 21. Thus, the rear stabilizer 31B projects from the left edge of the bottom plate 24. A bottom hole 32B is formed in the bottom plate 24 at a position where the cut portion is bent to form the rear stabilizer 31B.

Figure 3:
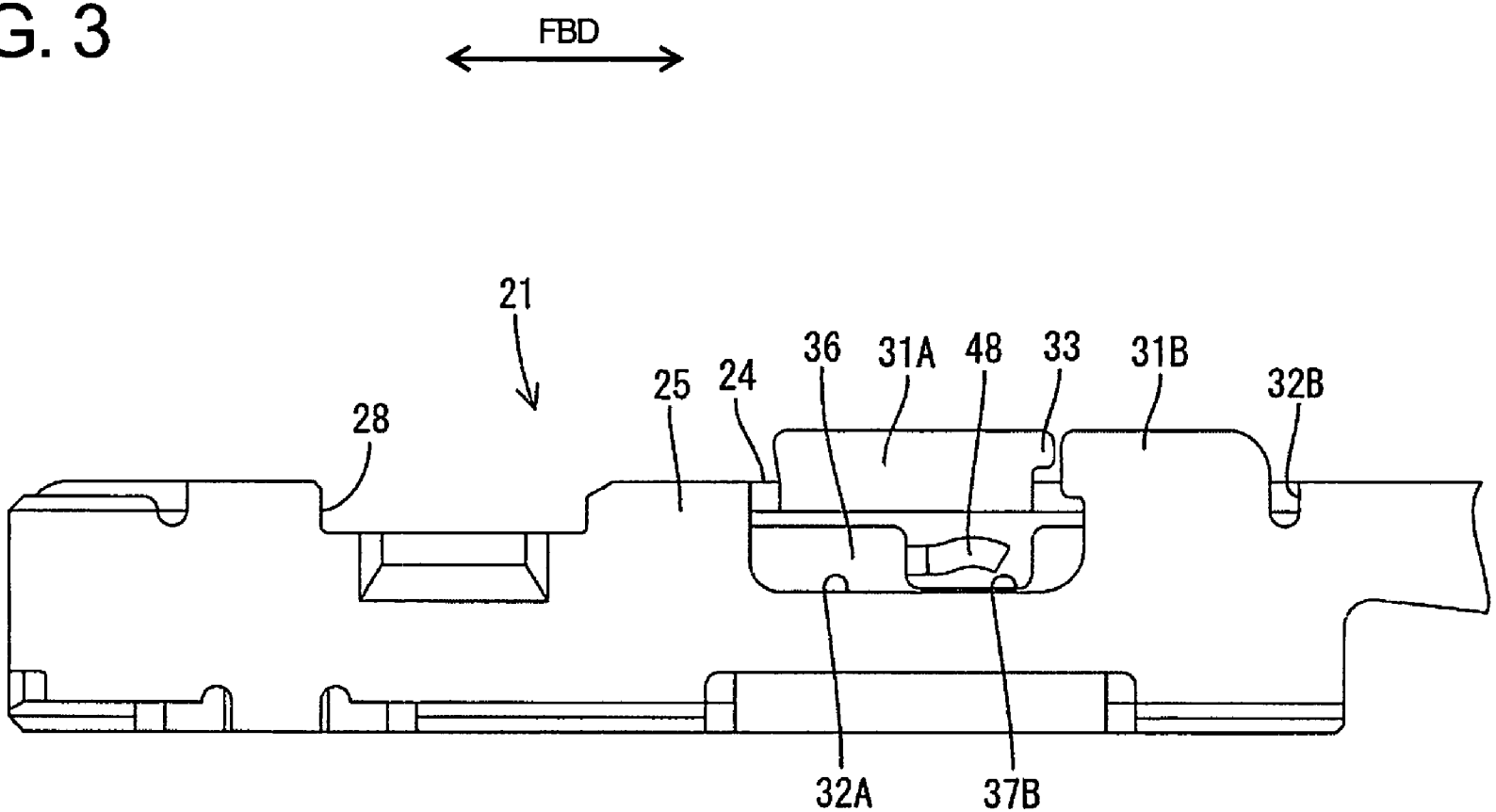
FIG. 3 is a left side view of the main portion.
Figure 4:
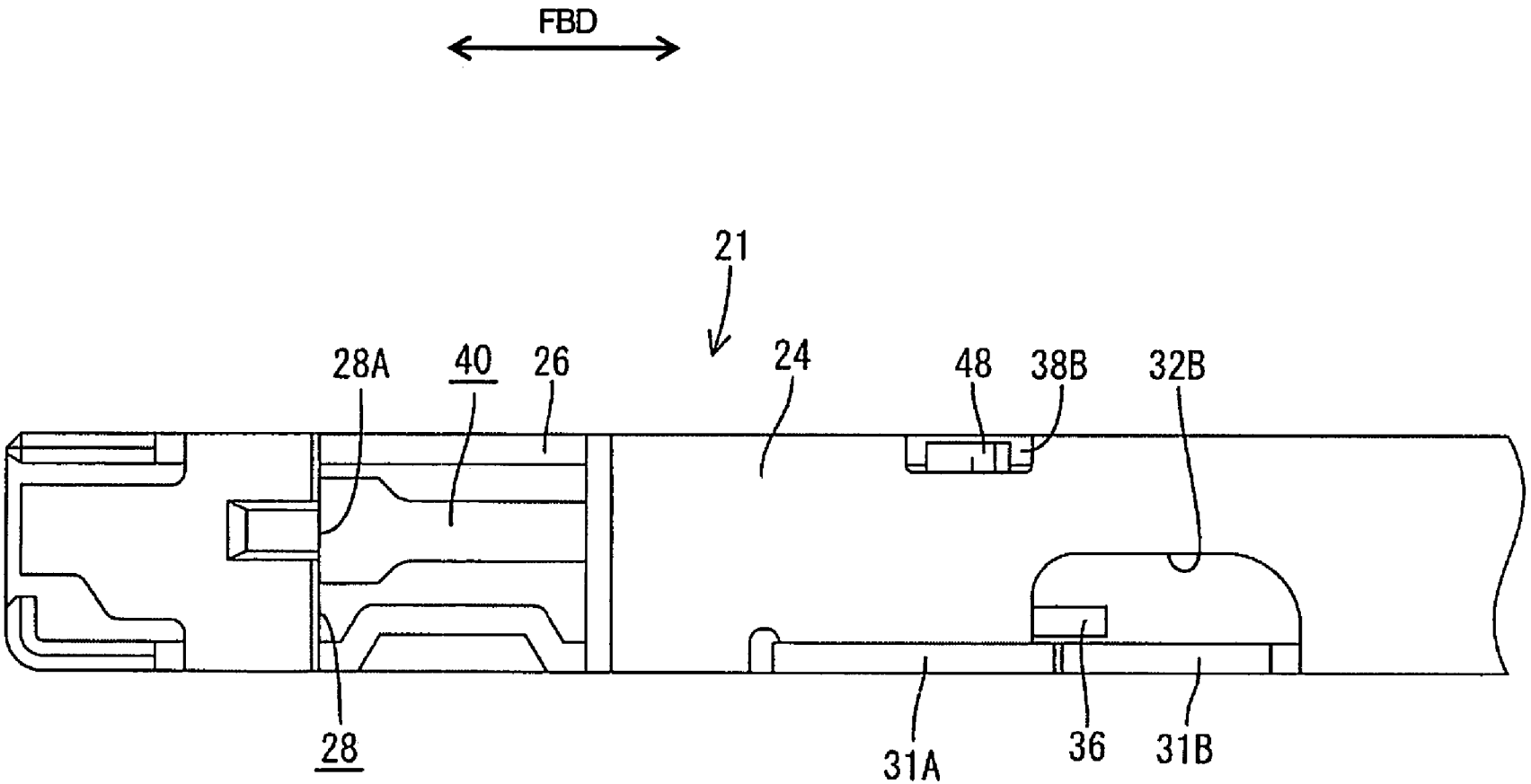
FIG. 4 is a bottom view of the main portion.

The front and rear stabilizers 31A, 31B substantially align with one another along the forward and backward directions FBD and project at substantially the same height, as shown in FIGS. 3 and 4. A narrowing portion 33 projects back from the rear edge of the front stabilizer 31A to narrow a spacing between the front and rear stabilizers 31A, 31B.

Front, rear and intermediate portions of an extending edge left edge of the ceiling plate 27 contacts the upper edge of the left side plate 25 from above. Front and rear inner plates 35, 36 extend down substantially normal to the ceiling plate 27 along the inner surface of the left side plate 25 at front and rear areas of the extending edge of the ceiling plate 27 that are not in contact with the upper edge of the left side plate 25.

The front inner plate 35 is substantially rectangular and has a bottom edge substantially at the center height of the main portion 21 to define a front preventing portion 37A. The rear inner plate 36 also has a rectangular shape, but is larger than the front inner plate 35. The rear inner plate 36 at least partly closes the side hole 32A produced by the cutting and bending to form the front stabilizer 31A. The bottom edge of the rear inner plate 36 is near the bottom plate 24, and a notch is formed at a position on the bottom edge shifted slightly towards the back. The upper edge of this notch defines a rear preventing portion 37B.

The right side plate 26 is formed with a substantially rectangular front locking hole 38A substantially corresponding to the front preventing portion 37A of the front inner plate 35 and a substantially rectangular rear locking hole 38B substantially corresponding to the rear preventing portion 37B of the rear inner plate 36.

Figure 6:
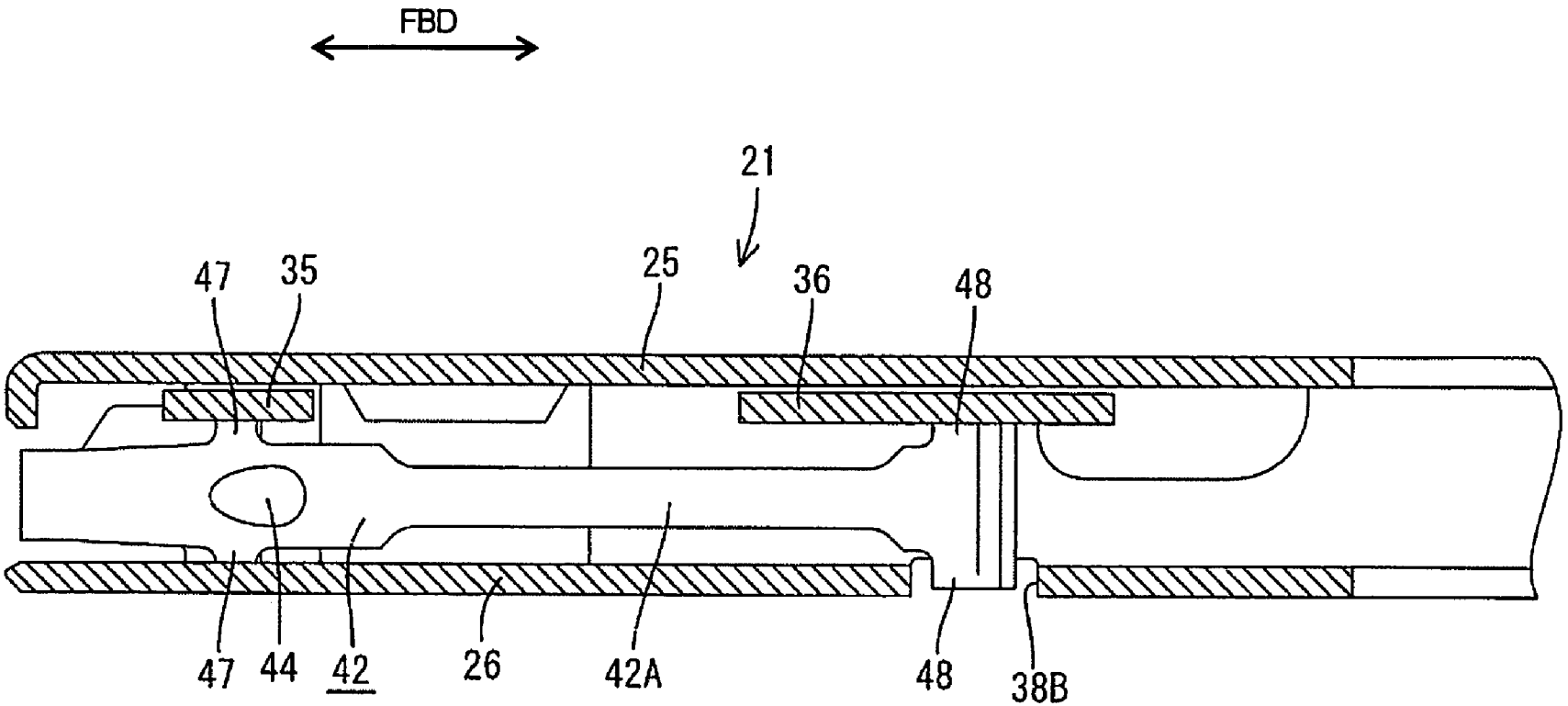
FIG. 6 is a section along VI—VI of FIG. 5.

A resilient contact 40 is accommodated in the main portion 21 and is configured for contacting the tab 51 of the mating male terminal fitting 50. The resilient contact 40 extends unitarily from the front end of the bottom plate 24 and is bent to cantilever backward. Additionally, the resilient contact 40 is narrow and long in forward and backward directions FBD. However, as shown in FIG. 6, the widthwise center of the resilient contact 40 is offset to the left when viewed from the front, and the widthwise center of the resilient contact 40 substantially coincides with the center of a spacing between the right side plate 26 and the inner plates 35, 36.

Figure 5:
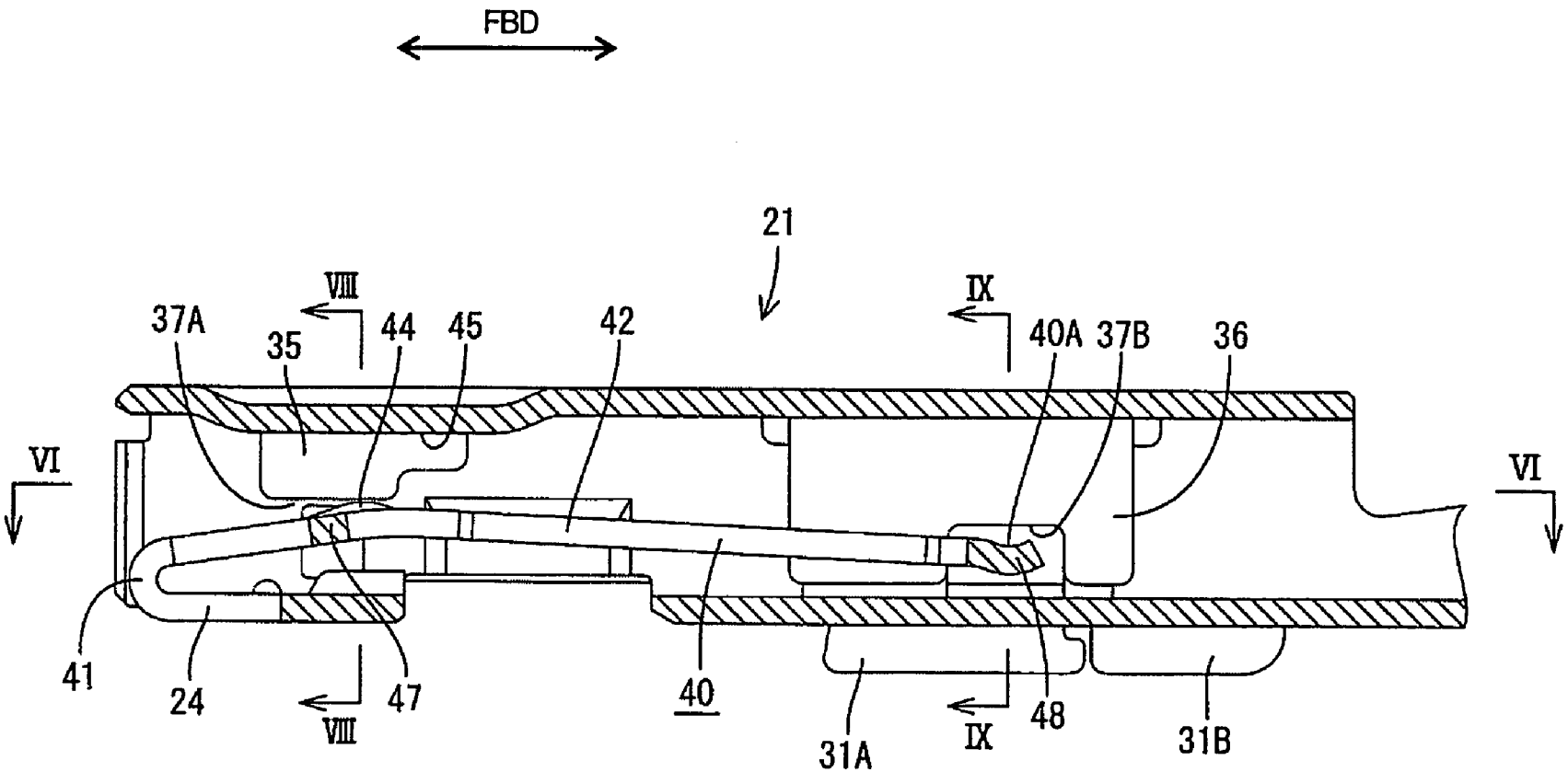
FIG. 5 is a longitudinal section of the main portion.

The resilient contact 40, as shown in FIG. 5, has a substantially arcuate bend 41 joined unitarily with the front end of the bottom plate 24 and an extending portion 42 extending from the bend 41 and moderately angled. In a free state, where the resilient contact 40 is not displaced, a free rear end 40A of the resilient contact 40 is distanced up from the bottom plate 24. Thus, the resilient contact 40 is supported only at the bend 41. The resilient contact 40 is resiliently displaceable up and down in a direction intersecting the inserting direction ID with at least the bend 41 as a supporting point while mainly bending the bend 41. The free end 40A of the resilient contact 40 contacts the inner surface of the bottom plate 24 when the resilient contact 40 is displaced down. Thus, the resilient contact 40 is supported at both front and rear ends.

A substantially dome-shaped contact point 44 is embossed substantially at the tip of the extending portion 42, and an area of the ceiling plate 27 corresponding to the contact point 44 is embossed to project down towards the resilient contact 40, thereby forming a tight holding portion 45. As shown in FIG. 6, an inclined portion 42A of the resilient contact 40 at a rear side of the extending portion 42 is narrower in a longitudinal middle part than at other parts.

Figure 8:
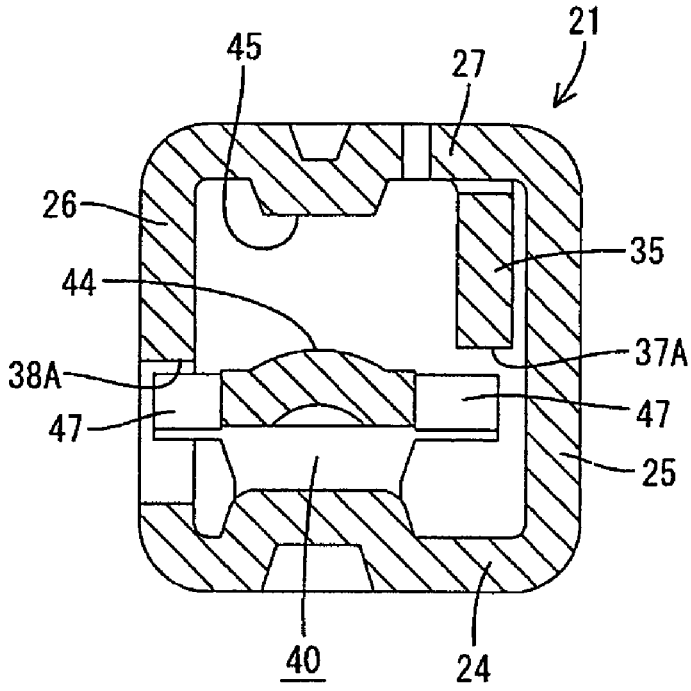
FIG. 8 is a section along VIII—VIII of FIG. 5.
Figure 9:
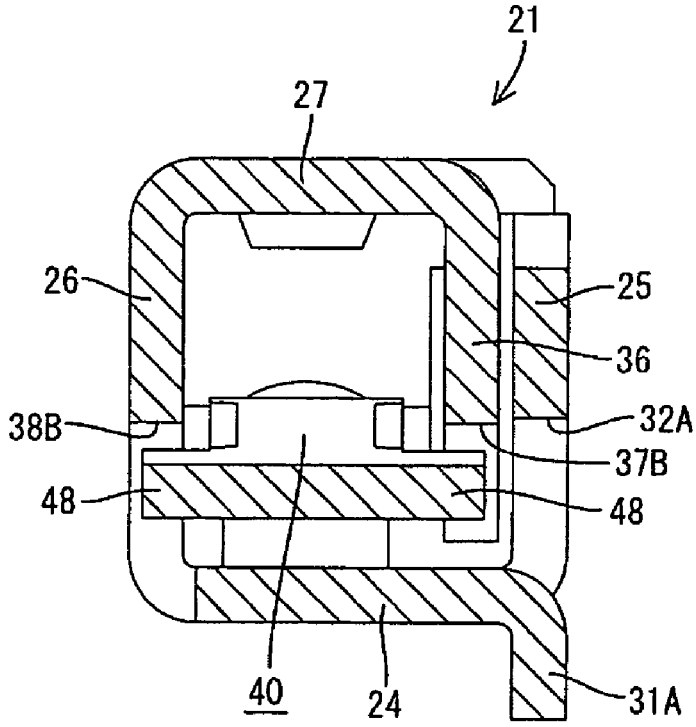
FIG. 9 is a section along IX—IX of FIG. 5.

Two front projections 47 and two rear projections 48 bulge out laterally from the left and right edges of the resilient contact 40, but are substantially flush with the resilient contact 40 in the thickness direction. The left and right front projections 47 are substantially symmetrical to each other and are slightly before the contact point 44. Additionally, the front projections 47 are located to correspond to the front preventing portion 37A of the front inner plate 35 and the front locking hole 38A of the right side plate 26 with respect to forward and backward directions FBD. In the free state where the resilient contact 40 is not resiliently displaced, the upper surfaces of the left and right front projections 47 are at non-contact positions slightly below the front preventing portion 37A and the upper edge of the front locking hole 38A corresponding thereto, as shown in FIG. 8.

The rear projections 48 are arranged at the free end 40A of the resilient contact 40. Additionally, the rear projections 48 are located to correspond to the rear preventing portion 37B of the rear inner plate 36 and the rear locking hole 38B of the right side plate 26 with respect to forward and backward directions FBD. In the free state, where the resilient contact 40 is not resiliently deformed, the upper surfaces of the left and right rear projections 48 are at non-contact positions slightly below the rear preventing portion 37B and the upper edge of the rear locking hole 38B corresponding thereto.

The female terminal fittings 20 are connected with the ends of the wires W by crimping the wire connecting portions 22. The stabilizer must have a long dimension along forward and backward directions FBD and must be formed by cutting and bending the main portion. Thus, a large hole could be formed in the main portion. However, in this embodiment, the front stabilizer 31A and the rear stabilizer 31B are formed separately by making cuts in different adjacent plates, namely the left side plate 25 and the bottom plate 24, and bending the cut portions. The combined length of the front and rear stabilizers 31A, 31B is sufficient to perform the required guiding and stabilizing function. However, the holes 32A, 32B produced in the different plates of the main portion 21 to form the front and rear stabilizers 31A, 31B are smaller than the hole that would have been produced to form a single stabilizer. Further, the rear inner plate 36 is at the inner side of the larger side hole 32A and at least partly closes this hole 32A.

The female terminal fittings 20 are connected with the ends of wires W and these assemblies of wires W and female terminal fittings 20 are bundled and transported to an operation site where the female terminal fittings 20 are inserted into the connector housing 10. As described above, the holes 32A, 32B produced by forming the stabilizers 31A, 31B are small and are in separate surfaces, i.e. the bottom plate 24 and the left side plate 25. Thus, stabilizer 30 of another of the bundled female terminal fittings 20 is less likely to enter the holes 32A, 32B and get entangled. The tab 51 of the mating male terminal fitting 50 or other external matter also is less likely to intrude. Therefore, the stabilizer, the tab 51 or other external matter is not likely to collide with and plastically deform the resilient contact 40 in the female terminal fitting 20.

The side hole 32A is larger than the bottom hole 32B, and hence has a higher probability of permitting the intrusion of external matter. Additionally, the side hole 32A is at a position to expose the free end 40 of the resilient contact piece 40. Thus, there is a possibility that the free end 40A may be deformed if external matter intrudes through the side hole 32A. However, the rear inner plate 36 at least partly closes the side hole 32A to prevent the intrusion of external matter through the side hole 32A.

The locking hole 28 also is relatively large, and there is a possibility that external matter could intrude and push the resilient contact 40 up. However, the front projections 47 can contact the front preventing portion 37A and the upper edge of the front locking hole 38A from below and the rear projections 48 can contact the rear preventing portion 37B and the upper edge of the rear locking hole 38B from below. Thus, upward deformation of the resilient contact 40 toward the insertion space for the tab 51 is limited. Further, the preventing portions 37A, 37B and the locking holes 38A, 38B are at front and rear positions behind the locking hole 28. Thus, there is no likelihood that the resilient contact 40 will incline forward or backward upon receiving a pressing force from external matter. This can prevent the bend 41, as a first supporting point of the resilient contact 40, from being plastically deformed.

The female terminal fittings 20 are inserted into the corresponding cavities 11 from behind and along the inserting direction ID while the retainer 15 is at the partial locking position shown in chain line in FIG. 11. The stabilizer 30 of the properly oriented female terminal fitting 20 faces down towards the guide groove 13. Thus, the female terminal fitting 20 is pushed and the stabilizer 30 is slid along the guide grooves 13, 15A in the wall of the cavity 11 where the lock 12 is provided and into the retainer 15.

The stabilizer 30 of an improperly oriented female terminal fitting 20 (e.g. upside down) contacts an edge 11A at the end of the cavity 11 to prevent any further insertion of the female terminal fitting 20. In this way, the improper (e.g. upside-down) insertion of the female terminal fitting 20 can be detected and prevented. The front of a stabilizer 30 of an improperly oriented female terminal fitting 20 might slip under the edge 11A that the stabilizer 30 is intended to contact if the female terminal fitting 20 is inclined down towards the front during insertion. However, the stabilizer 30 is long, and will bite in the inner wall of the cavity 11 at an early stage after having slipped under the edge 11A, thereby preventing any further insertion of the female terminal fitting 20 to securely detect and prevent the upside-down insertion.

The long stabilizer 30 of the properly oriented female terminal fitting 20 is guided along the guide groove 13. The length of the stabilizer 30 preferably is more than about one fourth, and more preferably greater than about one third of the longitudinal length of the main portion 21. The female terminal fitting 20 is pushed and resiliently deforming the lock 12 towards the final stage of the insertion and the lock 12 is restored resiliently up when the female terminal fitting 20 is inserted to a proper position. Thus, the retaining projection 12A enters the locking hole 28 and engages the locking edge 28A to lock the female terminal fitting 20. The retainer 15 then is pushed to the full locking position shown in solid line in FIG. 11, and the female terminal fittings are locked doubly so as not to come out.

The connector housing 10 is to be connected with the mating male connector after the female terminal fittings 20 are accommodated in the connector housing 10. Thus, the tabs 51 of the male terminal fittings 50 in the mating male connector are inserted through the tab insertion openings 17A of the front plate 17 and into the main portions 21 of the corresponding female terminal fittings 20 in the cavities 11. The tabs 51 move between the contact points 44 and the tightly holding portions 45 while resiliently displacing the resilient contacts 40, and are squeezed resiliently to electrically connect the female and male terminal fittings 20, 50.

As described above, the side hole 32A left upon forming the stabilizer 31A is relatively large and exposes the free end 40A of the resilient contact 40 to the outside. However, the rear inner plate 36 is arranged close to the inner side of the side hole 32A and at least partly closes the side hole 32A. Thus, the plastic deformation of parts of the resilient contact 40 towards the free end 40A can be prevented by preventing the intrusion of the tab 51 of the male terminal fitting 50 or other external matter through the side hole 32A. Further, the entanglement of the female terminal fittings 20 due to the intrusion of the stabilizers 30 of the other female terminal fittings 20 through the side holes 32A can be prevented while transporting the bundled wires W.

Projections 47, 48 are formed at front and rear positions of the left and right edges of the base end and the free end 40A of the resilient contact 40. The projections 47, 48 contact the preventing portions 37A, 37B of the main portion 21 and the edges of the locking holes 38A, 38B to prevent the resilient contact piece 40 from being deformed excessively towards the ceiling plate 27. The right projection 48 at the free end 40A is engageable with the preventing portion 37B of the rear inner plate 36, and is in the side hole 32A. Thus, the state of the projection 48 of the resilient contact 40 can be confirmed visually from the outside through the side hole 32A.

The projections 48, 47 at the left edge of the free end 40A and the base end of the resilient contact 40 must engage the left side plate 25. The projections 48, 47 might have to be long due to the offset of the resilient contact 40 relative to the widthwise center of the main portion 21. Longer projections 48, 47 could be too weak to resist forces imposed thereon and could bend. However, the projections 48, 47 merely need a length sufficient to engage the rear inner plate 36 and the front inner plate 35. The shorter projections 48, 47 are sufficiently strong.

The invention is not limited to the above described and illustrated embodiment. For example, the following embodiment is also embraced by the technical scope of the present invention as defined by the claims. Beside the following embodiment, various changes can be made without departing from the scope and spirit of the present invention as defined by the claims.

Although the stabilizer is divided into two parts in the foregoing embodiment, the invention is also applicable to a case where one stabilizer is provided or where a stabilizer is divided into three or more parts.

The surface(s) from which the stabilizer is formed can be selected depending on conditions, such as the position of the stabilizer and the position of the resilient contact.

The invention is not limited to the female terminal fittings illustrated in the foregoing embodiments, and is also applicable to male terminal fittings provided with one or more stabilizers.

The shape of the main portion of the terminal fitting is not limited to a rectangular tubular shape illustrated in the foregoing embodiments and may be any other shape such as a cylindrical shape or a polygonal shape.

The invention may also be applied to terminal fittings having plural groups of stabilizers provided at different position on the main portion thereof.

What is claimed is:

1. A terminal fitting comprising a substantially polygonal tubular main portion formed by a plurality of outer plates, at least one substantially planar stabilizer formed by making at least one cut in at least one of the outer plates and bending a cut portion of at least one of the outer plates to form the at least one stabilizer in a position so that the stabilizer is substantially coplanar with at least one of the outer plates and to form a hole in at least one of the outer plates adjacent the stabilizer, and an inner wall provided in the main portion, the inner wall being substantially parallel to a plane defined by the stabilizer and substantially adjacent the hole for at least partly closing the hole.

2. The terminal fitting of claim 1, wherein a resilient contact is formed in the main portion, at least one projection bulging out from a side edge of the resilient contact and substantially facing the inner wall, and at least the inner wall being formed with at least one preventing portion engaging the projection for limiting displacement of the resilient contact.

3. The terminal fitting of claim 2, wherein a widthwise center of the resilient contact is offset from a widthwise center of the main portion towards a side opposite the inner wall.

4. The terminal fitting of claim 1, wherein a resilient contact piece is formed in the main portion by being folded back from an end of a plate of the main portion.

5. The terminal fitting of claim 1, wherein the stabilizer is divided into a plurality of parts distanced from each other along forward and backward directions.

6. The terminal fitting of claim 5, wherein the respective divided parts of the stabilizer are formed from different outer plates of the main portion.

7. The terminal fitting of claim 1, wherein a resilient contact is formed in the main portion for contact a mating male terminal fitting inserted into the main portion, preventing portions being formed in the main portion and disposed for engaging the resilient contact to substantially prevent deflection of the resilient contact in a direction other than a deflection direction of the resilient contact caused by a mating male terminal fitting inserted into the main portion.

8. A connector comprising:

a housing having at least one cavity, a guide groove formed substantially along forward and backward directions at a specified position of an inner wall of the cavity; and at least one terminal fitting having a main portion formed by a plurality of outer plates, at least one substantially planar stabilizer formed by making at least one cut in at least one of the outer plates and bending a cut portion of at least one of the outer plates to form the at least one stabilizer in a position so that the stabilizer is substantially coplanar with at least one of the outer plates and to form a hole in at least one of the outer plates adjacent the stabilizer, the stabilizer being disposed and dimensioned for insertion into the guide groove, and an inner wall provided in the main portion, the inner wall being substantially parallel to a plane defined by the stabilizer and substantially adjacent the hole for at least partly closing the hole.

* * * * *